US011504557B2

(12) United States Patent
Boraas et al.

(10) Patent No.: US 11,504,557 B2
(45) Date of Patent: Nov. 22, 2022

(54) FALL-PROTECTION APPARATUS COMPRISING FRICTION BRAKE

(71) Applicant: 3M INNOVATIVE PROPERTIES COMPANY, St. Paul, MN (US)

(72) Inventors: Michael A. Boraas, Zumbrota, MN (US); Keith G. Mattson, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 487 days.

(21) Appl. No.: 16/630,584

(22) PCT Filed: Jul. 11, 2018

(86) PCT No.: PCT/IB2018/055124
§ 371 (c)(1),
(2) Date: Jan. 13, 2020

(87) PCT Pub. No.: WO2019/012454
PCT Pub. Date: Jan. 17, 2019

(65) Prior Publication Data

US 2021/0077840 A1 Mar. 18, 2021

Related U.S. Application Data

(60) Provisional application No. 62/531,984, filed on Jul. 13, 2017.

(51) Int. Cl.
*A62B 35/00* (2006.01)
*A62B 35/04* (2006.01)

(52) U.S. Cl.
CPC ..... *A62B 35/0093* (2013.01); *A62B 35/04* (2013.01)

(58) Field of Classification Search
CPC ..... A62B 35/0093; A62B 35/04
See application file for complete search history.

(56) References Cited

U.S. PATENT DOCUMENTS 5,308,516 A 5/1994 Chiddick
5,447,280 A * 9/1995 Feathers ..... A62B 1/10 242/396.6

(Continued)

FOREIGN PATENT DOCUMENTS

CN 201161891 Y 12/2008
EP 2316534 5/2011

(Continued)

OTHER PUBLICATIONS

ANSI/ASSE Z359.14-2012; Safety Requirements for Self-Retracting Devices for Personal Fall Arrest and Rescue Systems, MSA Safety, Nov. 2012, 4 pages.

(Continued)

*Primary Examiner* — Anita M King
(74) *Attorney, Agent, or Firm* — Kenneth B. Wood

(57) ABSTRACT

A non-motorized fall-protection apparatus, comprises a drum, and a rotationally-activated braking device that comprises at least one pawl and at least one ratchet with at least one tooth that is engagable by an engaging end of the at least one pawl, wherein the rotationally-activated braking device comprises a limited-use, constant-contact friction brake comprising at least one layer of friction material with a friction-braking surface and at least one rotatable member with a contact surface that is in contact with the friction-braking surface of the layer of friction material.

20 Claims, 5 Drawing Sheets

(56) References Cited

U.S. PATENT DOCUMENTS

| | | | | |
|---|---|---|---|---|
| 6,279,682 | B1 | 8/2001 | Feathers | |
| 6,630,416 | B1 | 10/2003 | Lam | |
| 7,281,620 | B2 | 10/2007 | Wolner | |
| 7,441,635 | B2 | 10/2008 | Rosenlocher | |
| 7,744,063 | B2 | 6/2010 | Jones | |
| 8,181,744 | B2 | 5/2012 | Parker | |
| 8,256,574 | B2 | 9/2012 | Griffiths | |
| 8,430,206 | B2 | 4/2013 | Griffiths | |
| 8,430,207 | B2 | 4/2013 | Griffiths | |
| 8,430,208 | B2 | 4/2013 | Griffiths | |
| 8,448,922 | B2 | 5/2013 | Gartrell, III | |
| 8,469,149 | B2 | 6/2013 | Meillet | |
| 8,511,434 | B2 | 8/2013 | Blomberg | |
| 8,567,562 | B2 | 10/2013 | Meillet | |
| 8,800,719 | B2 | 8/2014 | Auston | |
| 9,004,240 | B2 | 4/2015 | Palumbo | |
| 9,488,235 | B2 | 11/2016 | Casebolt | |
| 10,143,867 | B2 * | 12/2018 | Su | A62B 35/0075 |
| 10,661,106 | B2 * | 5/2020 | Choate | A62B 35/0093 |
| 2005/0051659 | A1 | 3/2005 | Wolner | |
| 2010/0226748 | A1 | 9/2010 | Wolner | |
| 2011/0315483 | A1 * | 12/2011 | Griffiths | A62B 1/10 182/232 |
| 2013/0206510 | A1 | 8/2013 | Casebolt | |
| 2014/0124310 | A1 | 8/2014 | Chiddick | |
| 2015/0217151 | A1 | 8/2015 | Jones | |
| 2016/0096048 | A1 | 4/2016 | Fegley | |
| 2022/0134164 | A1 * | 5/2022 | Bourquard | A62B 1/06 482/8 |

FOREIGN PATENT DOCUMENTS

| | | |
|---|---|---|
| JP | 63197469 | 8/1988 |
| WO | WO 2011/162985 | 12/2011 |
| WO | WO 2016-120614 | 8/2016 |

OTHER PUBLICATIONS

ANSI/ASSE Z359.14-2014; Safety Requirements for Self-Retracting Devices for Personal Fall Arrest & Rescue Systems, ASSE Tech Brief, Feb. 2015, 4 pages.

Carley, "Tech Feature: Brake Pad Friction Material Formulas", Brake & Front End, [available on internet Aug. 11, 2010], [retrieved from the internet Jul. 12, 2017], URL<http://www.brakeandfrontend.com/tech-feature-brake-pad-friction-material-formulas/>, 5 pages.

Ding, "Review on Shear Thickening Fluids and Applications", Textiles and Light Industrial Science and Technology, Oct. 2013, vol. 2, No. 4, pp. 161-173.

Roth, "Frictional Properties of Rubber", Journal of Research of the National Bureau of Standards, Apr. 1942, vol. 28, pp. 439-462.

User Manual: "SALA® Self Retracting Lifelines", DB Industries Inc, 2007, 40 pages.

"What are Brake Pads Made of?", Toyota Parts Center, [retrieved from the internet Jul. 12, 2017], URL<https://parts.olathetoyota.com/what-are-brake-pads-made-of>, 9 pages.

International Search Report for PCT International Application No. PCT/IB2018/055124, dated Oct. 29, 2018, 4 pages.

Supplementary EP Search Report for EP Patent Appl. No. 18832944.5 dated Feb. 16, 2021 3 pages.

* cited by examiner

FALL-PROTECTION APPARATUS COMPRISING FRICTION BRAKE

CROSS REFERENCE TO RELATED APPLICATIONS

This application is a national stage filing under 35 U.S.C. 371 of PCT/IB2018/055124, filed Jul. 11, 2018, which claims the benefit of provisional Application No. 62/531,984, filed Jul. 13, 2017, the disclosure of which is incorporated by reference in its/their entirety herein.

BACKGROUND

Fall-protection apparatus such as e.g. self-retracting lifelines have often found use in applications such as building construction and the like.

SUMMARY

In broad summary, herein is disclosed a fall-protection apparatus comprising a rotationally-activated braking device comprising a limited-use friction brake comprising a layer of friction material and a rotatable member. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Figure 1:
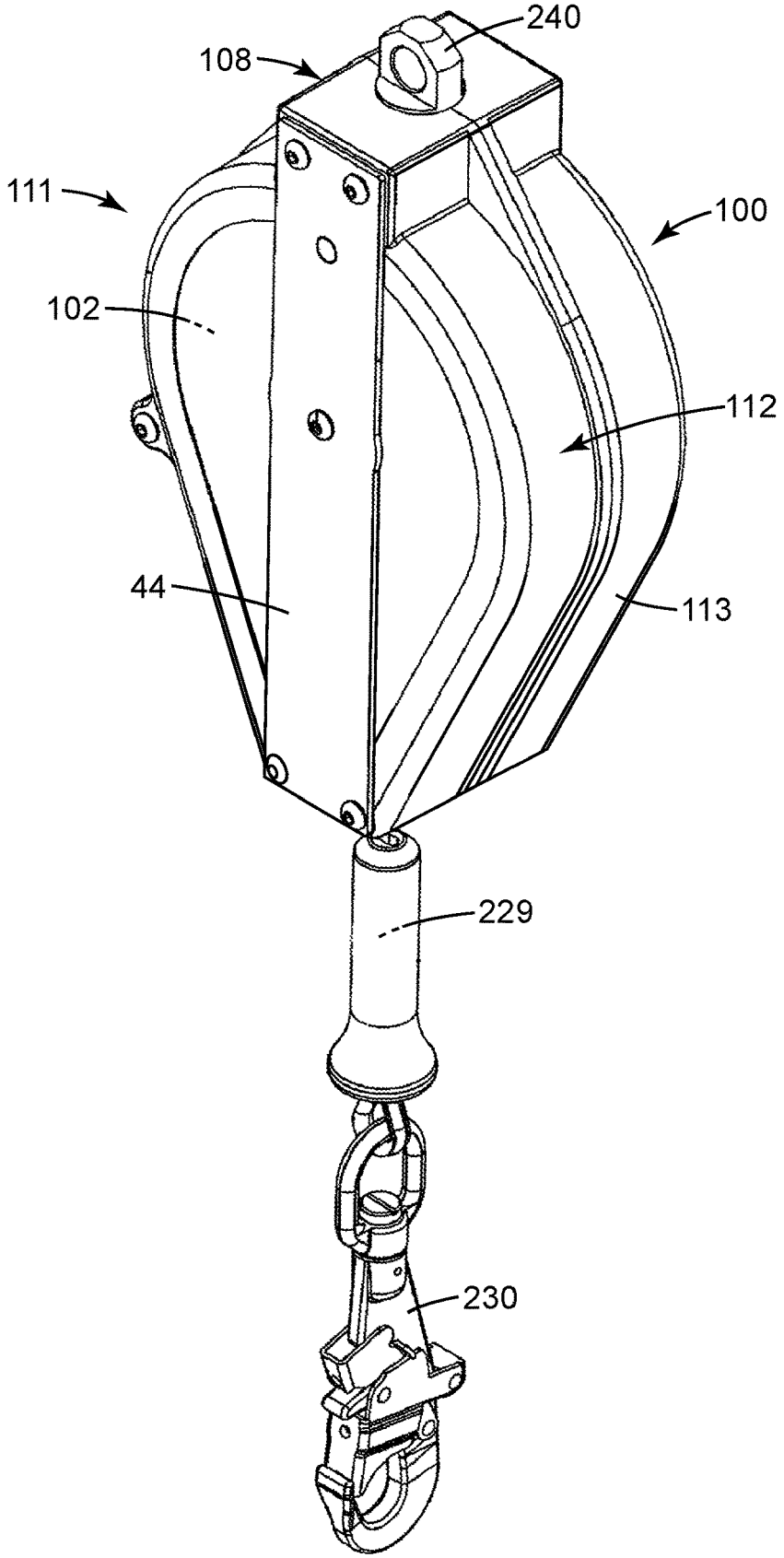
FIG. 1 is a perspective view of an exemplary fall-protection apparatus.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "front", "back", "outward", "inward", and "first" and "second" may be used in this disclosure, it should be understood that those terms are used in their relative sense only unless otherwise noted. Terms such as "top", bottom", "upper", lower", "under", "over", "horizontal", "vertical", and "up" and "down" will be understood to have their usual meaning with respect to the Earth.

As used herein as a modifier to a property or attribute, the term "generally", unless otherwise specifically defined, means that the property or attribute would be readily recognizable by a person of ordinary skill but without requiring a high degree of approximation (e.g., within +/−20% for quantifiable properties). The term "substantially", unless otherwise specifically defined, means to a high degree of approximation (e.g., within +/−10% for quantifiable properties). The term "essentially" means to a very high degree of approximation (e.g., within plus or minus 2% for quantifiable properties; it will be understood that the phrase "at least essentially" subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match. The term "configured to" and like terms is at least as restrictive as the term "adapted to", and requires actual design intention to perform the specified function rather than mere physical capability of performing such a function. All references herein to numerical parameters (dimensions, ratios, and so on) are understood to be calculable (unless otherwise noted) by the use of average values derived from a number of measurements of the parameter.

DETAILED DESCRIPTION

Disclosed herein is a fall-protection apparatus, by which is meant an apparatus that acts to controllably decelerate a human user of the apparatus in the event of a user fall. By definition, such a fall-protection apparatus is distinguished from devices such as hoists, winches, and the like that are used to raise or lower a non-human load. By definition, such a fall-protection apparatus is a non-motorized apparatus. By this is meant that a safety line of the apparatus is not moved (i.e., extended or retracted from a housing of the apparatus) by way of an electrically powered motor; in other words, the apparatus is not used as part of a system (e.g., an elevator, a hoist, etc.) that uses one or more motors to raise or lower a load.

In many embodiments, such a fall-protection apparatus is a self-retracting lifeline (SRL); i.e., a deceleration apparatus comprising a housing at least partially contains a drum-wound safety line that can be extended from the housing and retracted into the housing under slight tension during normal movement of a human user of the apparatus, and which, upon the onset of a user fall, automatically arrests (i.e., slows to a controlled rate, or completely stops) the fall of the user. Such an apparatus may comprise a safety line that can be extended out of a lower end of the apparatus with the apparatus having an upper, anchorage end which may be connected e.g. to a secure anchorage of a workplace. Often, such an apparatus may comprise a drum that is rotatably mounted within a housing therein such that such that the safety line can be wound about the drum when the line is retracted into the housing. Such an apparatus may further comprise a rotationally-activated braking device. By this is meant a device that is configured to arrest the rotation of the drum upon rotation of the drum above a predetermined value (noting that the term value encompasses speed, acceleration, or a combination thereof). In fall-protection apparatus of some types, such a rotationally-activated braking device may bring the drum to a "hard stop" (i.e., a near-instantaneous stop); in many such cases the safety line of the apparatus may include a so-called shock absorber (e.g. a tear web or tear strip) to minimize the force experienced by the human user as the user is brought to a halt. In fall-protection apparatus of the type of interest herein, the rotationally-activated braking device comprises a friction brake that, rather than bringing the drum to a "hard stop", brings the drum to a halt in a more gradual manner as described in detail later herein. This can minimize the force experienced by a human user as a fall is being arrested, e.g. without necessarily requiring the presence of a shock absorber in the safety line.

Figure 2:
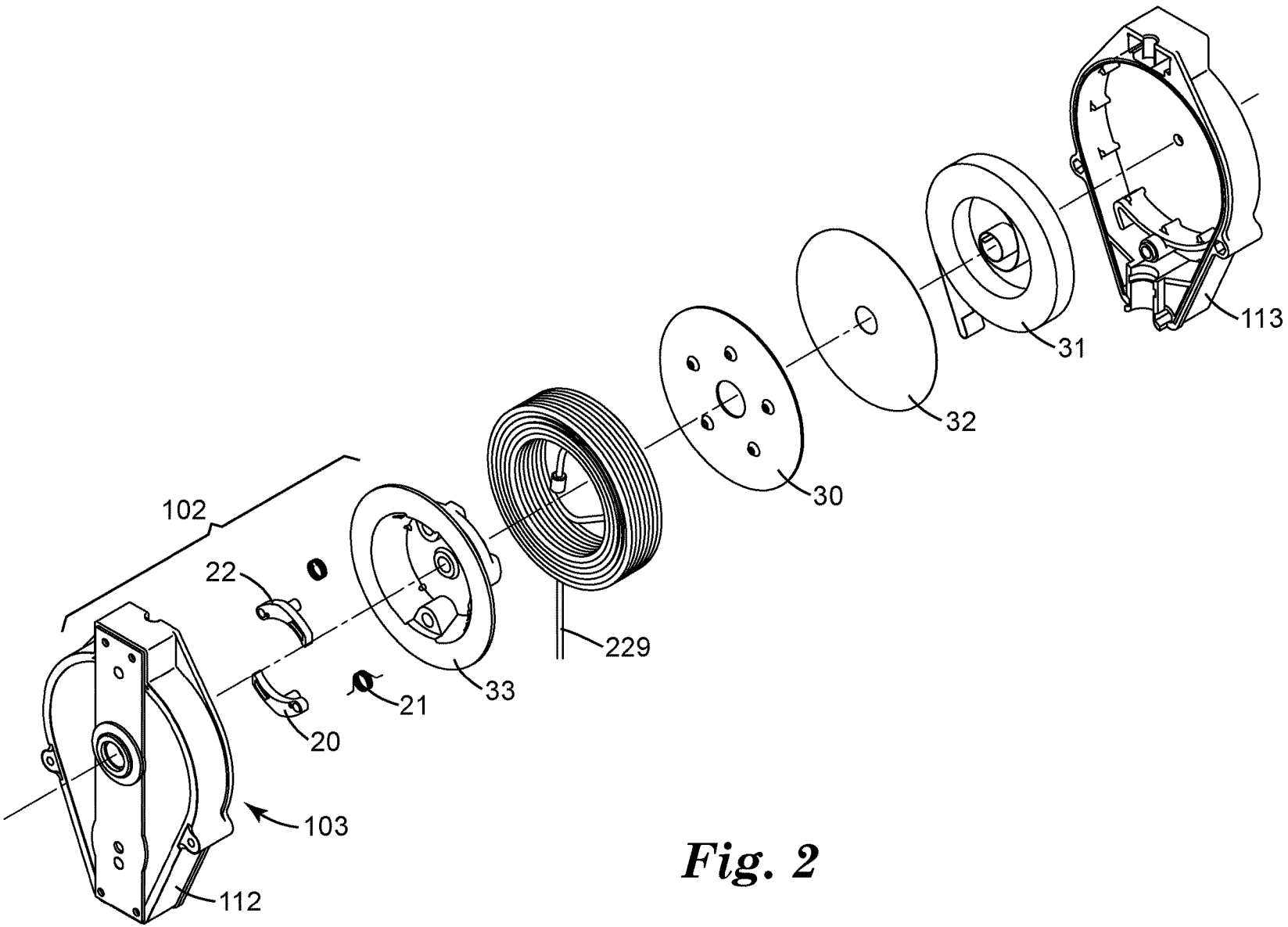
FIG. 2 is a perspective exploded view of various components of an exemplary fall-protection apparatus, including a rotationally-activated braking device.

An exemplary fall-protection apparatus 100 of the self-retracting lifeline type is depicted in FIGS. 1 and 2. Such an apparatus may comprise a housing 111 that is provided e.g. from a first housing piece 112 and second housing piece 113 that are assembled and fastened together to form the housing. Housing pieces 112 and 113 may be fastened together e.g. by bolts or by any other suitable fasteners. It is noted that many ancillary components such as e.g. one or more nuts, bolts, screws, shafts, washers, bushings, gaskets, bearings, and the like, are omitted from the Figures herein for ease of presentation of components of primary interest; ordinary artisans will readily appreciate that any such items may be present as needed for the functioning of apparatus 100. In some embodiments, housing 111 may be load-bearing; in some embodiments, a load bracket 44 or similar component may be present and may provide at least a portion of the load-bearing path of the apparatus.

Within an interior space at least partially defined by housing 111 is a drum 33, upon which is wound (e.g., spiral-wound) a length of safety line 229 (with the term line broadly encompassing any elongated windable load-bearing member, including e.g. webbing, cable, rope, etc., made of any suitable synthetic or natural polymeric material, metal, etc., or any combination thereof). In the illustrated embodiment, drum 33 comprises a main body and a flange 30, which, when joined to the main body, defines a space within which line 229 can be received and spiral-wound. A proximal end of line 229 is connected, directly or indirectly, to drum 33 (such a connection encompasses configurations in which the proximal end of line 229 is connected to a shaft on which drum 33 is mounted). In various embodiments, such a drum (e.g. a main body and/or flange thereof) may be made of metal (e.g. machined or cast metal), molded plastic, or any other suitable material. In some embodiments such a drum may be made of a single unitary piece of material, which may be e.g. a molded polymeric piece or a machined or cast metal piece. Drum 33 is rotatably connected to housing 111, e.g. by being rotatably mounted on a shaft or by being mounted on a shaft that is rotatable relative to the housing. A torsion spring 31 may be provided, e.g. external to drum 33 (and, in the depicted embodiment of FIG. 2, separated from drum 33 by an isolation disk 32), which serves to bias the drum toward rotating in a direction that will retract safety line 229 onto the drum unless the biasing force is overcome e.g. by movement of a human user.

Rotationally-Activated Braking Device

Within the space defined by the housing is a rotationally-activated braking device 102, as shown in exemplary embodiment in FIG. 2. Such a rotationally-activated braking device relies on one or more pawls 20 that are typically co-rotatable with drum 33. By co-rotatable with the drum is mean that the one or more pawls are able to rotate along with drum 33, with the pawl(s) moving in an orbital path about a center of orbital motion that coincides with the axis of rotation of the drum. In the illustrated embodiment of FIG. 2, such an arrangement is achieved by mounting two such pawls 20 directly to drum 33 so that they rotate along with drum 33. However, it may not be necessary that such a pawl(s) be mounted directly to drum 33 (for example, one or more pawls might be mounted on a pawl-support disk that is connected to the drum).

Any such pawl may be biased (in the depicted embodiment, this is performed by use of biasing springs 21) so that in ordinary use of the fall-protection apparatus, an engaging end 22 of the pawl is urged into a non-engaged position in which it does not engage with any component (e.g. a ratchet tooth) that would limit the rotation of the drum. This allows the drum to rotate to extend and retract the safety line in response to movements of a human user of the fall-protection apparatus. In the event that the drum begins to rotate above a predetermined value, at least one pawl is motivated (overcoming the biasing force of spring 21) to an engaged position in which the engaging end 22 of the pawl engages a tooth of a ratchet so as to slow and/or stop the rotation of the drum (as described in detail later herein). In many embodiments the one or more pawls may be pivotally mounted to be able to pivotally move between a disengaged position and an engaged position (as in the design of FIG. 2). However, in some embodiments the one or more pawls may be e.g. slidably mounted to be able to slidably move between a disengaged position and an engaged position (e.g., as in the arrangement disclosed in U.S. Pat. No. 8,256,574).

In the exemplary arrangement shown in FIG. 2, each pawl 20 comprises a heavy end that is opposite the engaging end 22, so that an increased speed of rotation causes the heavy end to move radially outward thus motivating the engaging end 22 radially inward. Such arrangements may be used with a ratchet that is radially outward-facing, e.g. a ratchet disk of the general type described later herein with reference to FIG. 3. In some embodiments a pawl may be configured so that the engaging end is an end of the pawl that is motivated to move radially outward to be engaged; such arrangements may be used with a ratchet that is radially inward-facing (e.g. a ratchet ring of the general type shown in FIG. 4 of the above-cited '574 patent). In general, one or more pawls of any suitable design may be used, made of any material (e.g. stainless steel) with appropriate mechanical strength; various pawl designs and configurations are described e.g. in U.S. Pat. Nos. 7,281,620, 8,430,206, 8,430,208, and 9,488,235.

In use of exemplary fall-protection apparatus 100, an upper, anchorage end 108 of the apparatus may be connected (e.g. by way of connection feature 240) to a secure anchorage (fixed point) of a workplace structure (e.g., a girder, beam or the like). The distal end of line 229 may then be attached (e.g., by way of hook 230) to a harness worn by a worker. As the human user moves away from the fixed anchorage, line 229 is extended from within housing 111; as the user moves toward the fixed anchorage, drum 33 rotates under the urging of torsion spring 31, so that line 229 is self-retracted within housing 111 and wound upon drum 33. During such user activities, pawls 20 are biased by the aforementioned biasing springs 21 so that an engaging end 22 of a pawl 20 does not engage a ratchet of the rotationally-activated braking device. In the event that the human user falls and causes line 229 to be rapidly extended from housing 111, the rotation of drum 33 increases above a predetermined value (of e.g. speed), whereupon an engaging end 22 of at least one pawl 20 is caused to engage with a ratchet, whereupon the falling of the worker is arrested as discussed in detail later herein. Various parameters of the rotationally-activated braking device (e.g. the weight and shape of the pawls, the spring constant of the biasing springs, and so on) may be chosen so that the engaging of the pawls with the ratchet occurs at a predetermined e.g. speed of rotation of the drum.

In many embodiments the centrifugal force resulting from rotational (i.e., orbital) motion of the pawls causes the one or more pawls to transition from a disengaged position to an engaged position. However, in some embodiments, such a transition may occur at least in part by way of a pawl, while moving along a path of orbital motion, impinging upon an item that (if the pawl is moving sufficiently fast) physically dislodges the pawl from its disengaged position and urges it towards an engaged position. Such an item might be e.g. a tooth of a ratchet (e.g. a stationary ratchet) that is positioned to lie at least partially in the orbital path of the moving pawl. A similar effect may be achieved by mounting one or more pawls so that they are not able to rotatably move along an orbital path but are able to pivot (e.g., rock) while remaining in place. An item such as e.g. a rotatable ratchet can then be positioned so that if the item rotates at a sufficient speed a portion of the item impacts a portion of the pawl so as to physically dislodge the pawl from an disengaged position and urge (e.g. pivot) the pawl toward an engaged position. Arrangements of this general type are disclosed e.g. in U.S. Pat. No. 6,279,682 to Feathers, which is incorporated by reference in its entirety herein. It is noted that any assembly (including those disclosed in the '682 patent) that makes use of relative rotational motion between at least one pawl and a ratchet to activate braking, falls within the category of a rotationally-activated braking device as disclosed herein (noting that arrangements of the type disclosed in the '682 patent, in which the pawls do not follow an orbital path so as to rotate along with a drum, will be an exception to the principle that rotationally-activated braking devices typically comprise a pawl or pawls that are co-rotatable with a drum of the assembly).

Friction Brake

A rotationally-activated braking device as disclosed herein will comprise a ratchet that comprises at least one tooth that can be engaged by the above-mentioned engaging end of a pawl. Such a ratchet may be made of any material that exhibits sufficient strength to withstand the forces that develop in the engaging/braking process; in many embodiments such a ratchet may be comprised of stainless steel, e.g. chosen from the 300 Series (austenitic) category of stainless steel. Various ratchet designs and arrangements are discussed in detail below.

A rotationally-activated braking device as disclosed herein will also comprise a friction brake. By definition a friction brake will comprise at least one layer of friction material and at least one rotatable member, with a friction-braking surface of the layer of friction material being in contact (typically, at all times during ordinary use of the fall-protection apparatus) with a contact surface of the rotatable member. By a rotatable member is meant an item (e.g., a disk, ring, rotor, or the like) that is configured so that the member and the layer of friction material can be set into rotating motion relative to each other upon sufficient differential torque being applied to the layer of friction material and the rotatable member as the result of the engaging of a pawl with a ratchet of the rotationally-activated braking device. In many embodiments, the friction-braking surface of the layer of friction-braking material and the contact surface of the rotatable member are pressed together to provide sufficient static frictional force that, as a human user moves about a workplace in ordinary use of the apparatus, there is no relative motion between the two surfaces. However, upon the engaging of a pawl with a ratchet of the rotationally-activated braking device, sufficient differential torque is generated to overcome the static frictional force, such that relative motion of the two surfaces (and hence relative motion of the rotatable member and the layer of friction material) may occur. The rotatable member and the layer of friction material are configured so that this relative rotation of the layer of friction material and the rotatable member will be slowed and/or brought to a halt by the frictional forces between the friction-braking surface of the layer of friction material and the contact surface of the rotatable member. The slowing of this relative rotation will serve to slow (e.g. halt) the rotation of a drum bearing a safety line.

Figure 3:
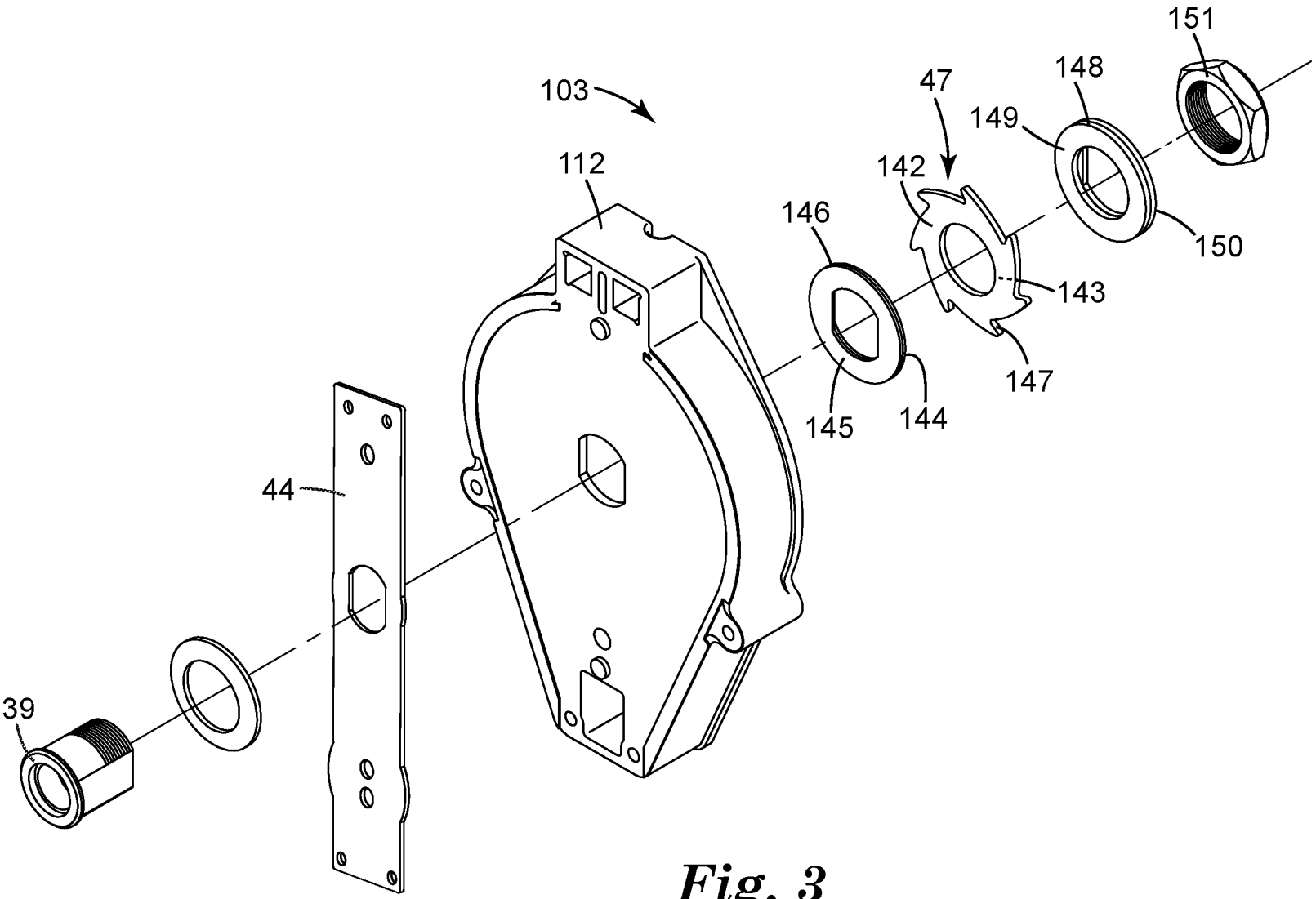
FIG. 3 is an isolated perspective exploded view of various components of an exemplary fall-protection apparatus, including a friction brake of a rotationally-activated braking device.

In some exemplary embodiments, a rotationally-activated braking device 102 may comprise a friction brake 103 of the general type disclosed in the isolated exploded view of FIG. 3. Such a friction brake 103 comprises a ratchet 47 (in this instance, a radially outward-facing toothed disk) that comprises at least one tooth 147 that can be engaged by an above-mentioned engaging end 22 of a pawl 20. In the exemplary design, ratchet 47 is mounted on a keyed (e.g., flat-sided) shaft 39 which passes through complementary keyed apertures in housing piece 112 and load strap 44 as depicted in FIG. 3. While shaft 39 is thus unable to rotate relative to the housing of the apparatus, ratchet 47 is able to rotate relative to shaft 39 and thus relative to the housing of the apparatus. Ratchet 47 is sandwiched between first and second layers 146 and 148 of friction material. Each layer of friction material is respectively bonded to, and supported by, a support plate 145 and 150 (made of e.g. a metal such as stainless steel) that is keyed to shaft 39, so that each layer of friction material cannot rotate relative to shaft 39. The first layer of friction material 146 comprises a first friction-braking surface 144 that is in contact with first contact surface 142 of ratchet 47; the second layer of friction material 148 comprises a second friction-braking surface 149 that is in contact with second contact surface 143 of ratchet 147. In assembly of friction brake 103, a locking nut 151 is screwed onto a threaded terminal portion of keyed shaft 39 to an extent chosen (e.g. by the use of a torque wrench) to exert a desired amount of pressure on the friction brake. This causes first and second friction-braking surfaces 144 and 149 of first and second layers 146 and 148 of friction material to be pressed against contact surfaces 142 and 142 of ratchet 47 with a force chosen to impart a desired amount of frictional resistance to motion and thus to provide a desired braking power. For example, this force may be chosen so that the fall of a human user will be arrested within a suitably short time and/or within a suitably short distance of falling, while not subjecting the user to undesirably forces resulting from the act of braking.

Figure 4:
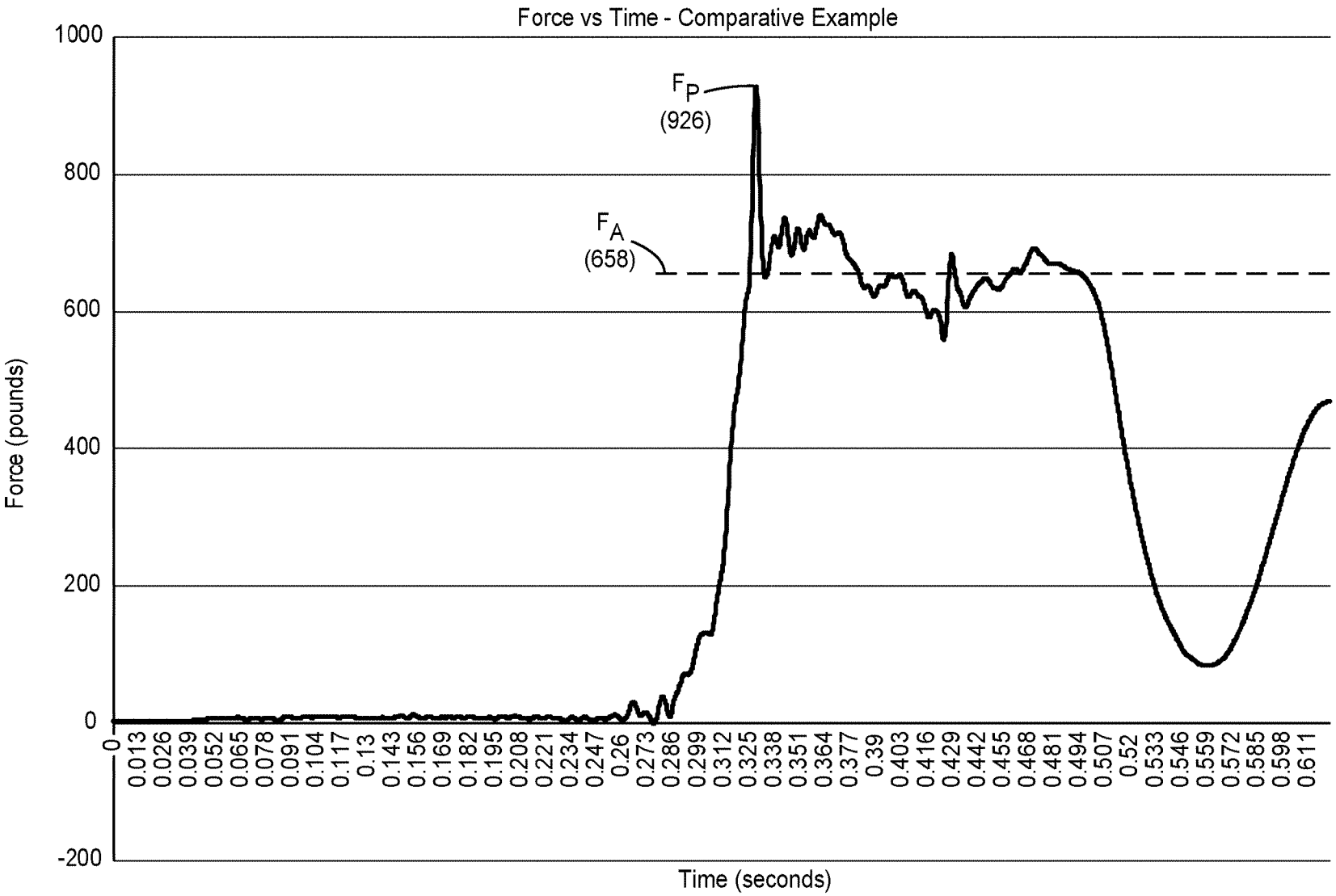
FIG. 4 presents force-versus-time data for a Comparative Example fall-protection apparatus.

It will be appreciated that the particular design depicted in FIG. 3 is merely one example of a friction brake and of a ratchet arrangement; many different arrangements are possible. For example, FIG. 3 depicts a ratchet that comprises two contact surfaces and that is sandwiched between two layers of friction material. In other embodiments, a ratchet of a friction brake may only comprise a single contact surface which may be in contact with only a single layer of friction material. Furthermore, a ratchet may be radially inward-facing rather than radially outward-facing rather as in FIG. 3. A friction brake that comprises a ratchet in the form of a radially-inward-facing toothed ring, and that comprises only a single contact surface that is in contact with a friction-braking surface of a single layer of friction material, is depicted in FIG. 4 of U.S. Pat. No. 8,430,206 to Griffiths, which is incorporated by reference herein in its entirety.

In some embodiments, it may be convenient for a ratchet of the rotationally-activated braking device to serve as a rotatable member of the friction brake of the braking device. It will be appreciated that the rotationally-activated braking device and friction brake as described above with reference to FIGS. 2-3, fall into this general category. In many such designs, the ratchet is able to rotate with respect to the housing of the apparatus, but typically remains stationary during ordinary use of the apparatus. That is, the drum may rotate (relatively slowly) relative to the housing to extend and retract the safety line as a human user moves about a workplace. However, the ratchet, not being subjected to any rotational force, and being frictionally constrained by one or more layers of friction material that are keyed to a shaft as described above, does not rotate relative to the housing. In the event that the drum begins to rotate rapidly e.g. due to a fall, the engaging end of a pawl (e.g., a drum-mounted pawl) engages with a tooth of the ratchet and overcomes this frictional constraint and causes the ratchet to rotate relative to the layer(s) of friction material and thus relative to the housing of the apparatus. The friction between the friction-braking surface of the friction material and the contact surface of the ratchet then slows or halts the rotation of the ratchet relative to the housing of the apparatus thus slowing or halting the rotating of the rotatable drum relative to the housing of the apparatus. The products available from 3M Fall Protection, Red Wing, Minn., under the trade designation ULTRA-LOK provide examples of fall-protection apparatus that include a rotationally-activated braking device with a friction brake arranged in this manner.

In other embodiments, the rotatable member of a friction brake of a rotationally-activated braking device may not necessarily serve as a ratchet of the braking device. Rather, in some cases the ratchet of the rotationally-activated braking device and the rotatable member of the friction brake of the rotationally-activated braking device may be separate items. In one exemplary arrangement of this general type, a rotatable member of the friction brake may take the form of e.g. a plate, disk, or the like upon which the pawl or pawls of the braking device are mounted, with a contact surface of the rotatable member being in contact with a friction-braking surface of a layer of friction material. The layer of friction material is mounted on a support plate that is keyed to the safety-line-receiving drum of the apparatus so that the layer of friction material cannot rotate relative to the drum. In some such embodiments, the ratchet of the braking device can be non-rotatable relative to the housing of the apparatus (for example, the ratchet may be provided as an integral feature of the housing, e.g. molded directly into a housing piece of the apparatus). The engaging of an engaging end of a pawl with a tooth of the ratchet will thus cause the rotatable member on which the pawl is mounted to near-instantaneously cease rotating, while the differential torque between the rotatable member and the layer of friction material allows the layer of friction material, and thus the drum, to continue to rotate momentarily. The frictional force between the contact surface of the rotatable member and the friction-braking surface of the layer of friction material slows or halts the rotation of the layer of friction material and thus slows or halts the rotation of the drum itself.

The products available from 3M Fall Protection, Red Wing, Minn., under the trade designation REBEL provide examples of fall-protection products of this general type, in which a rotationally-activated braking device comprises a rotatable member and a ratchet that are separate items. The REBEL product line also provides an example of a friction brake that uses a single layer of friction material rather than two layers with a rotatable member sandwiched therebetween. It will be appreciated that many variations of the above-presented exemplary arrangements may be employed. For example, if desired, multiple layers of friction materials, and/or multiple rotatable members, may be present.

In some embodiments a ratchet, rather than being provided e.g. as a toothed disk or ring that is made separately and inserted into a housing of a fall-protection apparatus, may be provided e.g. as an integral (e.g. molded, cast, or machined) feature of the housing of the apparatus. The above-mentioned REBEL product line provides an example of this type of ratchet. Another possible variation in ratchet design is presented in U.S. Pat. No. 9,488,235, in which a ratchet takes the form of a single tooth ("stop member") that is provided as an integral part of a bracket (e.g., a load-bearing bracket) of a fall-protection apparatus. It will be evident that the apparatus described in the '235 patent is one in which a rotationally-activated braking device brings the drum to a "hard" (near-instantaneous) stop upon engaging a pawl with the stop member; that is, the '235 rotationally-activated braking device does not comprise a friction brake. Instead, a shock absorber is provided in the safety line of the apparatus. The '235 patent thus does not include a friction brake and is cited herein merely to illustrate permissible variations in ratchet design. Any suitable ratchet design, including any of the ratchet designs and arrangements described herein, may be used in a rotationally-activated braking device as disclosed herein.

From the above discussions it will be clear that a ratchet of a rotationally-activated braking device can be any component (e.g. a toothed disk or ring, or a portion of a fall-protection bracket or housing) that presents at least one tooth that can be engaged by an engaging end of a pawl to initiate braking operation of the rotationally-activated braking device. It is emphasized that the term "ratchet" is used for convenience of description; use of this term does not require that the ratchet and pawl(s) must necessarily be arranged e.g. so that relative rotation of these components is permitted in one direction but is precluded in the opposite direction. (However, the ratchet and pawl(s) can be arranged so that such functionality is provided if desired.) It is further emphasized that the arrangements and functionalities disclosed herein may be used in a rotationally-activated braking device of any design.

A friction brake as disclosed herein comprises at least one layer of friction material that comprises at least one friction-braking surface that is configured to contact a contact surface of a rotatable member of the friction brake. In some embodiments a layer of friction material may be disposed on (e.g. laminated or bonded to) a support plate as discussed herein. In other embodiments, a layer of friction material may be "free-standing" rather than being bonded to a support plate. In some embodiments, a layer (e.g. a free-standing layer) of friction material, and a rotatable member (e.g. a ratchet), may be sandwiched between e.g. a backing plate and a pressure plate, which may enhance the uniformity with which a friction-braking surface of the layer of friction material and a contact surface of the rotatable member of the friction brake are pressed together. An arrangement of this general type is depicted in U.S. Pat. No. 8,430,206.

Limited-Use Brake

By definition, a rotationally-activated braking device, and in particular a friction brake thereof, of a fall-protection apparatus as disclosed herein is a limited-use item. By limited-use is meant that the braking device and friction brake are not activated during ordinary use of the fall-protection apparatus (e.g., while a human user of the device is performing workplace operations and/or moving about a workplace). Rather, the braking device and friction brake thereof are only activated upon the onset of a fall. A friction brake as disclosed herein is thus by definition distinguished from friction brakes of movable vehicles, from centrifugal brakes or clutches of motorized machinery, and the like.

In various embodiments, a limited-use friction brake may be activated no more than ten, five, or two times over the useful life of the fall-protection apparatus. In some embodiments, such a friction brake will be a single-use item that is activated no more than once. That is, in ordinary use of many such fall-protection apparatus, the rotationally-activated braking device and the friction brake thereof will remain in a state of readiness, but will rarely be activated. Furthermore, in the event of a fall (e.g. so that an "impact indicator" of the apparatus is tripped or activated), it is customary for the fall-protection apparatus to be removed from service (e.g. shipped back to the manufacturer) to be inspected, reconditioned and/or refurbished as needed (as discussed e.g. in U.S. Pat. No. 7,744,063). So, in the relatively rare event that the friction brake of a fall-protection apparatus is activated, the friction material of the friction brake will often be replaced prior to any subsequent use of the apparatus.

Ordinary artisans will be aware that the readiness of a rotationally-activated braking device of an apparatus such as a self-retracting lifeline is often checked in the field, e.g. by way of a human user giving a quick pull on the safety line to engage the pawl(s) with the ratchet to confirm that the rotationally-activated braking device is able to "lock up" as needed. However, since the force exerted in such lock-up testing is far lower than the forces encountered when actually arresting a user fall, such lock-up testing typically will not result in any significant movement of the contact surface of the rotatable member (e.g., ratchet) of the friction brake relative to the friction-braking surface of the layer of friction material (and, such testing typically will not have the effect of significantly abrading or wearing away any portion of the layer of friction material). This being the case, such lock-up testing is not considered a "use" or "activation" of the friction brake in the context considered herein.

From the above discussions it will be clear that a friction brake of a fall-protection apparatus is used in a very different manner than the vast majority of friction brakes as used e.g. in movable vehicles, in machinery such as clutches, differentials, torque convertors, and the like. The latter uses typically involve very high numbers (e.g. thousands) of activations of the friction brake over its useful lifetime. Manufacturers and users of such friction brakes are thus concerned with ensuring that the friction material does not exhibit excessive wear, that it does not excessively abrade the surface that it is in contact with (e.g. of a vehicular brake disk, rotor, or brake drum), and that the performance of the friction material remains relatively constant even as much of the friction material is worn away over repeated use. In contrast, a friction material of a friction brake of a fall-protection apparatus may, over much or all of the useful lifetime of the apparatus, exhibit the identical friction-braking surface as when the friction brake was originally installed in the apparatus. Thus in many embodiments a layer of friction material of a fall-protection apparatus will be a non-wear item, which is thus distinguished from e.g. vehicular brake pads and the like.

Constant-Contact Brake

In many embodiments a friction brake of a rotationally-activated braking device of a fall-protection apparatus as disclosed herein is a constant-contact brake. By this is meant that during use operation of the fall-protection apparatus the friction-braking surface of the layer of friction material remains in direct, intimate contact with the contact surface of the rotatable member. By this is further meant that during ordinary use of the apparatus, no relative motion (slippage) between the two surfaces is present unless a user fall occurs. Such a constant-contact brake is distinguished from e.g. brakes or clutches of vehicles or motorized machinery in which relative motion/slippage between a friction-braking surface and a contact surface occurs often and repeatedly during ordinary operation of the vehicle or machinery. In particular a constant-contact brake may be contrasted with friction brakes that spend much of the time with the layer of friction material retracted away from a contact surface so that a gap is present between the friction-braking surface of the layer of friction material, and the contact surface.

It will be appreciated that because a friction brake of a fall-protection apparatus such as e.g. a self-retracting lifeline is seldom activated, and typically arrests the fall of a human user within a fraction of a second (e.g. within in about 0.2-0.3 seconds), the friction material is unlikely to be subject to issues such as the need to minimize noise generation during operation, or the need to ensure that performance does not deteriorate during extended periods of continuous use or upon multiple uses in rapid succession. Still further, such friction material is unlikely to be subject to issues regarding performance in the presence of large amounts of water or lubricating oil or with issues regarding the rapidity with which the friction material wears away the contact surface of a rotatable member of the friction brake. This is all in sharp contrast to the issues that arise in use of friction materials in e.g. as vehicular brake pads, in clutches and transmissions of motorized machinery, and so on. Such considerations perhaps explain why it does not appear that any major efforts to develop and optimize friction materials for the particular area of friction brakes for fall-protection apparatus, have occurred in recent years.

The above discussions have presented that in various fall-protection apparatus, a friction brake is used to provide that the fall of a human user is arrested somewhat gradually and gently rather than bringing the user to an abrupt halt. This can advantageously minimize the forces that are encountered during the process of arresting the fall. An ongoing need in the fall-protection industry lies in the fact that many rotationally-activated braking devices of all-protection apparatus do not provide a braking force that is uniform over the duration of the braking operation. Rather, the braking force often varies widely over the duration of the braking operation and in particular may exhibit a relatively short-duration peak braking force that is substantially higher than the braking force that is present during other portions of the braking operation. Since a very high braking force (even if short in duration) may be undesirable, it has often been necessary to configure friction brakes of rotationally-activated braking devices so that the average braking force over the duration of the braking operation is lower than would otherwise be desired, in order to ensure that the peak braking force remains below a specified level.

The present work reveals that in many cases, the peak braking force that occurs during a friction-braking operation of a rotationally-activated braking device of a fall-protection apparatus, is an initial braking force that develops upon the initial activation of the rotationally-activated braking device. Such behavior is documented in FIG. 4, which is a Comparative Example drop test showing a typical braking force vs. time curve for the arresting of a fall by a self-retracting lifeline with a friction brake that uses friction materials representative of those customarily used in the industry. It is evident that the initial braking force displays a sharp peak ($F_p$, 926 pounds of force) that is significantly higher than the average braking force ($F_a$, 658 pounds of force).

Ratio of Peak Braking Force to Average Braking Force

Figure 5:
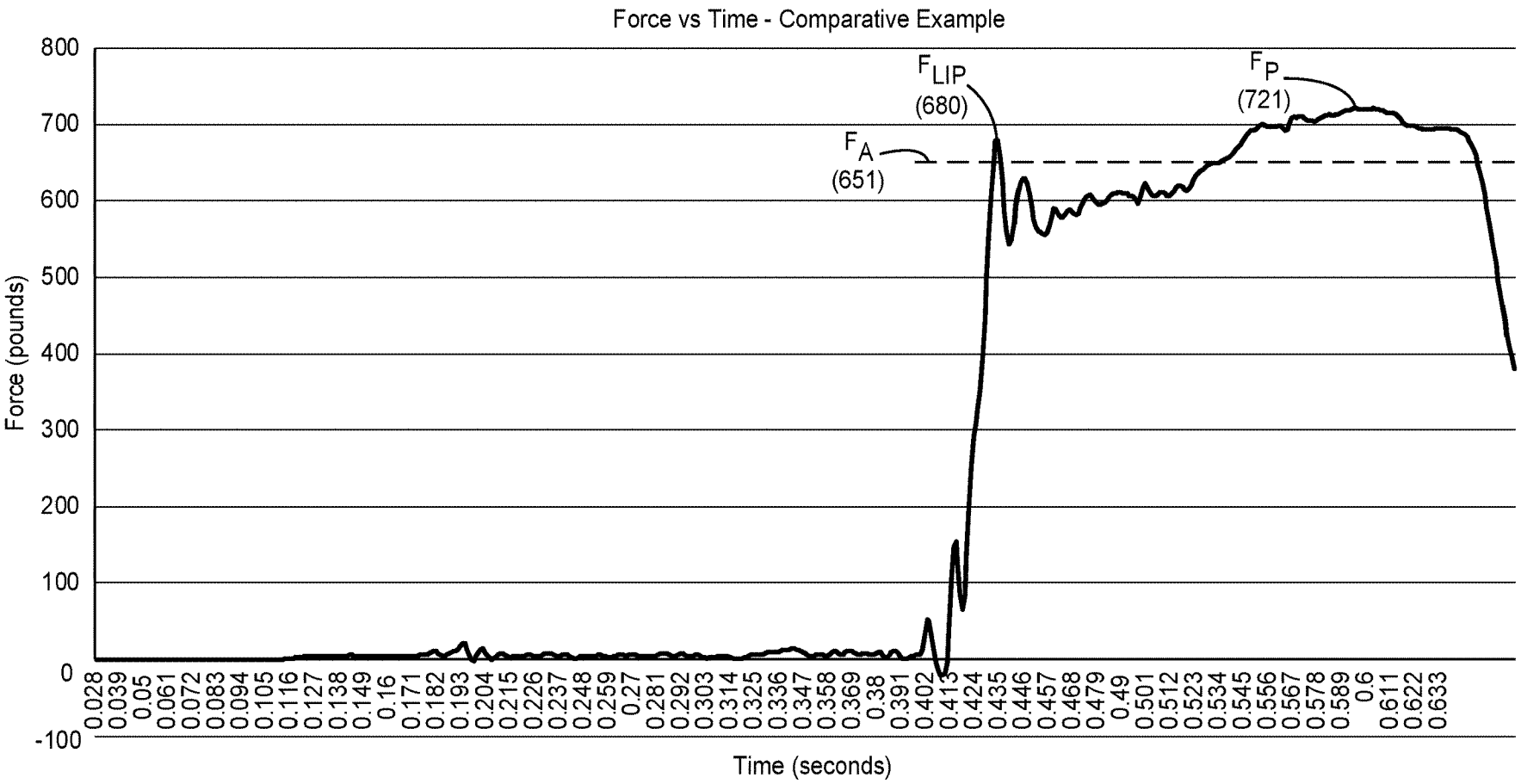
FIG. 5 presents force-versus-time data for a Working Example fall-protection apparatus.

As evidenced by the force vs. time curve presented in the Working Example drop test of FIG. 5, the inventive fall-protection apparatus disclosed herein exhibit a significantly reduced tendency for a peak braking force to develop upon initial activation of the rotationally-activated braking device that is markedly higher than the braking force applied over the remainder of the braking operation. In fact, FIG. 5 shows that while a small local initial peak may occur, this local-peak force may in fact be lower than the force that is present over much of the remainder of the braking operation. This Working Example exhibited an absolute peak force $F_p$ of 721 pounds (which actually occurred toward the end of the braking operation rather than at the onset of braking) and an average force $F_a$ of 651 pounds. The peak force to average force ratio for this Working Example was thus approximately 1.1, versus a peak force to average force ratio of approximately 1.4 for the Comparative Example presented above. In various embodiments, a friction brake as disclosed herein may exhibit a peak force to average force ratio of less than about 1.3, 1.2, 1.15, 1.1, 1.05, or 1.02.

In some embodiments, the performance of a friction brake may be characterized by the local slope of the force curve at the peak force that occurs during the braking operation. For purposes of such characterization, a time period (starting from the time of peak force and proceeding forward in time) of 4 milliseconds or until a significant local minimum in force is encountered, can be used. For example, for the Comparative Example of FIG. 4, such a local slope will be (926−655)/4, which corresponds to a change in braking force of approximately 70 pounds force per millisecond of braking time. For the Working Example of FIG. 5, such a local slope will be (721−720)/4 or approximately 0.2 pounds force per millisecond of braking time. It will thus be appreciated that even in circumstances in which a local peak in the force curve may occur upon initial activation of the brake (as in FIG. 5), the fact that the maximum force may occur later, e.g. in a relatively flat portion of the force curve, may allow the overall braking force to be maximized relative to the maximum force that is present. In various embodiments, a friction brake as disclosed herein may exhibit a local slope of the force curve at the peak force, of less than about 40, 20, 10, 4, 2, 1, 0.5, 0.3, 0.2, or 0.1 change in pounds force per millisecond of braking time.

In some embodiments, the performance of a friction brake may be characterized by the ratio of the braking force at a local initial force peak (if one is present), to the average braking force. For the Working Example of FIG. 5, a local initial force peak is evident and exhibits a force of 680 pounds. Such a ratio would therefore 680/658, or approximately 1.0. (Since in the Comparative Example of FIG. 4 the local initial peak force is the same as the absolute peak force (926 pounds), for this example the ratio will be 926/658, or approximately 1.4). Thus in various embodiments, a friction brake as disclosed herein may exhibit a ratio of local initial peak force to average force of less than about 1.3, 1.25, 1.15, 1.10, 1.05, 1.0, or 0.95.

It will be appreciated that (regardless of in what particular quantitative manner the performance of a friction brake of a rotationally-activated braking device of a fall-protection apparatus is characterized) the providing of a braking operation that does not exhibit an initial peak force that is significantly higher than the force developed over the remainder of the braking operation, can allow a higher average braking force to be achieved without causing the peak braking force to exceed a desired value. This can advantageously enhance the braking efficiency of the rotationally-activated braking device and may provide, for example, that the desired braking may be achieved over a shorter duration of time and/or a shorter distance of falling. That is, braking action that is more efficient, while at the same time being smoother and in particular not subjecting a user to a relatively large initial peak force when the rotationally-activated braking device is first activated, may be achieved. In various embodiments, a fall-protection apparatus as disclosed herein will exhibit a peak braking force of less than 1500, 1200, or 900 pounds.

The discussions above reveal that the problem of a peak braking force that significantly exceeds the overall, average braking force during a braking operation, may, in at least some instances, arise from the presence of an initial braking force that greatly exceeds the subsequent braking force. This may be due at least in part to a difference in the static and dynamic frictional behavior of the materials used in the friction brake. This may also arise at least in part from inertial effects that occur upon initial activation of the rotationally-activated braking device. With the guidance provided by these findings, the performance of rotationally-activated braking devices in fall-protection apparatus can be enhanced.

It has now been appreciated that it can be useful to minimize the frictional interaction between the friction-braking surface of a layer of friction material and the contact surface of a rotatable member under unmoving (static) conditions, relative to the frictional interaction between these surfaces under moving (dynamic) conditions. In other words, minimizing the static frictional interaction between these surfaces in relation to the dynamic frictional interaction between these surfaces can minimize the force that develops when the two surfaces first begin to move relative to each other, relative to the forces that occur over the remainder of the braking operation. This can allow an advantageously high average braking force to be used over the duration of the braking operation, while still remaining below a desired peak braking force.

A reduction in the peak force encountered in a braking operation may be obtained e.g. by configuring the contact surface of the rotatable member of the friction brake and the friction-braking surface of the layer of friction material in combination, to preferentially decrease the braking force present upon initial engaging of the brake in comparison to the braking force present during the remainder of the braking operation. (This may be alternatively viewed as preferentially increasing the braking force present during the remainder of the braking operation, relative to the initial braking force). In some embodiments, this may be achieved at least in part by increasing the frictional forces present under dynamic (moving) conditions, in relation to the frictional forces present under static (non-moving) conditions. Conventional parameters such as the coefficient of dynamic (kinetic) friction and the coefficient of static friction may provide a guide to such behavior. However, ordinary artisans will appreciate that such parameters rely on a simplistic model of frictional phenomena (often referred to as the "Coulomb" model or "standard" model of friction) which does not take into account various factors which will be discussed later herein. It will thus be appreciated that while various methods of measuring friction coefficients may be used to screen potentially useful materials, the most suitable way of determining whether a friction material will provide enhanced braking performance in a friction brake of a fall-protection apparatus is to install the material in a fall-protection apparatus and subject the apparatus to a drop test as disclosed herein.

Nevertheless, various test apparatus and procedures that measure friction coefficients may be used to screen potentially useful materials. For example, coefficient of friction testing may be performed using a rheometer, e.g. the product available from TA Instruments, New Castle, Del. (USA), under the trade designation ARES-G2 RHEOMETER, equipped with a Tribo-Rheometry Accessory. (All numerical values of static and dynamic friction coefficients mentioned herein will be obtained from such rheometer testing, unless otherwise specified.) For such testing, a layer of friction material may be mounted on a support plate for ease of handling. Using such a rheometer, the friction-braking surface of the friction material sample is contacted with a contact surface of a sample of a rotatable member with a specified force, after which the samples are moved relative to each other at a specified speed. (Convenient test conditions may provide for the testing to be performed room temperature, at a nominal normal force of 20 N and at a nominal sliding speed of 4 m/s.) The friction material and/or the rotatable member material may be sized and shaped as needed to conform to the test apparatus, noting that the effects of any such manipulations may be minimal since the results will typically be cast in the form of a ratio of the coefficient of static friction to the coefficient of dynamic friction, obtained using the same sample format and geometry.

Screening of potentially useful materials may also be performed by using a so-called nano indenter test apparatus, e.g. the product available under the trade designation Nano Indenter G200 from Keysight Technologies, Santa Rosa, Calif., equipped with a Lateral Force Measurement (LFM) option. In such testing, a probe tip (e.g. of a relatively large diameter, e.g. 1 mm, and chosen of a material, e.g. stainless steel, to represent the contact surface of a rotatable member of a friction brake) is contacted with the surface of the test specimen with a specified force, after which the probe tip and test specimen are moved relative to each other at a desired speed. Screening of potentially useful materials may also be performed by using a sliding, weighted sled apparatus and procedure of the general type disclosed in ASTM Test Method D1894-14. Frictional characteristics of vehicular brake pads are often evaluated by use of an inertial dynamometer or CHASE apparatus; such an apparatus may be used for screening potentially suitable materials if desired. In any such testing, sufficient repetitions may be performed to obtain statistically meaningful results. However (in view of the above discussions that the layer of friction material is typically not a wear item), in order to provide that the test method most resembles actual use conditions, no single sample should be subjected to repeated testing that wears away a significant portion of the layer of friction material.

Thus in some embodiments, the frictional behavior of a friction-braking surface of a layer of friction material, and a contact surface of a rotatable member, may be assessed by measuring a coefficient of static friction between the friction-braking surface of the layer of friction material and the contact surface of the rotatable member, and by measuring a coefficient of dynamic friction between these same two surfaces. In some embodiments, the coefficient of static friction of these two surfaces may be about equal to, or less than, the coefficient of dynamic friction of these surfaces. In this context, "about equal to" means that the ratio of the coefficient of static friction of these surfaces to the coefficient of dynamic friction of these surfaces is no more than 1.09; in various embodiments, the ratio is less than 1.04 or 1.01.

In the present work it has been appreciated that inertial effects due to the rapid motion of the pawl(s), the drum, and/or any portion of the safety line that is wrapped on the drum, at the time the friction brake is first activated, may also contribute to a peak force that develops upon first activating the rotationally-activated braking device. This being the case, in some embodiments it can be advantageous to provide that the coefficient of static friction of the two above-cited surfaces is less than the coefficient of dynamic friction of the two surfaces. Thus in various embodiments, the ratio of the coefficient of static friction to the coefficient of dynamic friction of these two surfaces may be less than 1.00, 0.99, 0.97, 0.95, 0.92, 0.90, 0.85, or 0.80.

In some embodiments, the composition of at least the contact surface of a rotatable member of a rotationally-activatable braking device may be chosen to promote an elevated frictional force under dynamic conditions, in comparison to the frictional force under static conditions. However, in some embodiments (e.g. if the rotatable member is to be a ratchet of the friction brake), the choices available for the rotatable member may be somewhat limited in view of e.g. strength requirements. Thus, in many embodiments the rotatable member may be made of e.g. a metal such as stainless steel (e.g. a 300 Series steel), brass, bronze, etc. Within any such limitations imposed by such requirements, the composition of the rotatable member may be varied to promote the effects disclosed herein. Furthermore, the contact surface of the rotatable member may be coated, treated, or the like, e.g. to desirably promote an elevated frictional force under dynamic conditions.

Composition of Friction Material

The composition of the layer of friction material may be chosen to promote an elevated frictional force under dynamic conditions in comparison to the frictional force under static conditions. An ordinary artisan may select from any suitable friction material in view of the guidance provided herein. A layer of friction material may take any suitable physical form and geometry. Thus in some embodiments a layer of friction material may be e.g. a layer (e.g. a ring or disk) of monolithic material. However, in some convenient embodiments, the friction material may be a composite material, with a first (matrix) phase and with a second phase that comprises one or more additives. In some embodiments, the first phase may comprise an organic polymeric binder; for example a cross-linked organic polymeric binder such as e.g. a cured epoxy resin, phenol-formaldehyde resin, or urethane resin. In many convenient embodiments such a binder may take the form of a liquid or latex (to which the one or more additives are added) that is crosslinked and/or solidified to form the first phase; however, in some embodiments a binder may include at least some particles that are e.g. melted or otherwise agglomerated, and crosslinked or cured if desired. In particular embodiments, the first phase may comprise a fibrous network (e.g. a nonwoven web) that is impregnated with a binder. In various embodiments, the first phase (e.g. the binder) may comprise at least about 5, 10, 15, 20, 30, 40, 50, 60, 70, or 80 wt. percent of the total friction material. In further embodiments, the first phase (e.g. the binder) may comprise at most about 85, 75, 65, 55, 45, 35, 25, 18, 13, or 8 wt. percent of the total friction material.

In some embodiments the additive(s) of the second phase may comprise one or more particulate materials, which term is used broadly and includes any materials that are present e.g. in the form of particles, granules, powders, fibers, and so on. Such particulate materials may be of any shape, size, or aspect ratio, and may be present as discrete entities or may be present in such quantity, size and/or form as to occupy a second phase that is at least semi-continuous. In various embodiments, any such particulate material may comprise an average particle size of at least 0.1, 0.5, 1.0, 5.0, 10, 20, 50, or 100 microns. In further embodiments, any such particulate material may comprise an average particle size of at most 1000, 500, 400, 300, 200, 120, 80, or 40 microns. (If multiple particulate materials of differing composition are included, the particle size of each type of material may be evaluated separately; for fiber additives, the length of the fibers may be used as the particle size.)

Additives may be chosen e.g. from filler materials (e.g. particles and/or fibers), abrasive materials (e.g. particles), structural (e.g. reinforcing) materials, and any of various performance additives that are sometimes added to e.g. vehicular brake pads. Some such materials may merely serve e.g. as relatively inexpensive space-fillers while others may impart specific characteristics (e.g. they may be abrasive in nature, or may serve to enhance the structural integrity of the friction material). It will be appreciated that the boundaries between such functional categories may not be bright-line boundaries and that many such additives may serve multiple functions. (It is also noted that many materials have historically been included in friction materials for e.g. vehicular brake pads to impart properties (e.g. resistance to wear and uniformity of performance, over long-term use) that are of little or no concern in the present application.)

Specific additives, e.g. particulate additives, that may be included in a friction material may include e.g. inorganic particulates such as e.g. mineral fillers, quartz, barium sulfate, calcium hydroxide, calcium carbonate, aluminum oxide, talc, clay, diatomaceous earth, mica, molybdenum disulfide, potassium titanate, metal sulfides, ceramic microspheres, and/or inorganic fibers such as fiberglass or mineral wool. Other ingredients that may be included are carbon-based or carbon-containing materials such as e.g. carbon black, graphite, coal dust, ground or granulated (e.g. recycled) rubber, ground nutshells such as e.g. cashew nutshells, carbon fiber, particulate or fibrous Kevlar, particulate or fibrous aramids, and the like. Other potential ingredients include metallic materials such as e.g. iron or steel powder and particulate copper. In some embodiments, liquid or semi-liquid materials (e.g. oils, waxes, or putties) of any desired composition may be included, e.g. as a lubricant, stabilizer, or for any other function. (Particular liquids that have found use in e.g. vehicular brake pads include, for example, cashew nutshell liquid, linseed oil, and so on, noting that in some instances some such additives may cross-link to form a portion of the above-described first phase of the composition) Any such additives may be e.g. mixed into a curable resin (e.g. an epoxy resin and/or a phenol-formaldehyde resin) to form a mixture which may then be reacted (cured) to form a composite material. In some embodiments, one or more additional polymers or resins (whether curable or not; e.g. a curable or non-curable silicone resin) may be included.

Various ingredients and additives which may be included in friction materials are described e.g. in U.S. Pat. No. 6,630,416 to Lam, U.S. Pat. No. 7,441,635 to Rosenlocher, and in U.S. Patent Application Publication 2014/0124310 to Chiddick, all of which are incorporated by reference herein in their entirety for this purpose. Some of these sources may provide ordinary artisans with useful guidance as to the effect of various ingredients and compositions on the behavior of friction materials. It is emphasized however that such documents are, in the main, concerned with manipulating friction material compositions to address issues (e.g., minimizing the generation of noise during braking, or maximizing the ability to rapidly dissipate heat and/or the ability to resist performance degradation, upon prolonged exposure to high temperatures), that would not be considered relevant to use of friction materials in fall-protection apparatus. In particular, such documents do not guide an ordinary artisan toward the manipulation of friction material compositions to reduce an initial peak in force upon the engaging of a rotationally-activated braking device of a fall-protection apparatus, in relation to the braking force over the remainder of the braking operation.

The discoveries presented herein reveal that a modification that increases the frictional interaction between the surface of the friction material and the contact surface of the rotatable member during the latter portion of a braking operation (i.e., after the initial onset of the braking operation), may advantageously enhance the braking performance of a fall-protection apparatus. While in some cases such an enhancement may be manifested by an increase in the ratio of static to dynamic coefficient of friction as measured by one of the above-discussed test methods, it will be appreciated that such methodology may provide an incomplete or superficial view of the tribological phenomena that actually occur during a friction-braking operation of a fall-protection apparatus. That is, methods that provide coefficients of friction are based on simplistic models of friction as noted earlier herein, and may not take into account, for example, that dynamic frictional interactions may vary as a function of the magnitude of the shear force between the surfaces and/or as a function of the duration of the shear force. Moreover, dynamic frictional interaction may vary as a function of some variable (e.g. local temperature) that itself varies as a function of the magnitude and/or duration of the shear force.

Thus, an enhancement in the braking performance of a friction brake of a rotationally-activated braking device of a fall-protection may not necessarily be captured in conventionally measured coefficients of friction. For example, the Working Example data of FIG. 5 shows that, after slight oscillations at the onset of braking, the braking force seems to increase during the majority of the remainder of the braking operation. This indicates that tribological phenomena may be occurring that is not well represented e.g. by a single, constant coefficient of dynamic friction; and, that the enhanced braking behavior that is observed may not be explainable, or predictable, based solely on a ratio of a measured coefficient of static friction to a measured coefficient of dynamic friction.

In various embodiments, a layer of friction material of a friction brake may include one or more additives that serve to provide enhanced braking performance, e.g. by promoting increased dynamic frictional interaction of the friction-braking surface of the layer of friction material with the contact surface of the rotatable member during the latter stages of the friction-braking operation. For example, in some embodiments such an additive might be a granular (particulate) material that exhibits the property known as dilatancy; that is, a material whose volume increases when exposed to a shearing force. Particulate additives of such a material, when exposed at the friction-braking surface of the friction material and when subjected to a shearing frictional force against a contact surface of a rotatable member, may tend to expand (e.g. swell) outward against the contact surface of the rotatable member in such manner as to increase the frictional interaction between the surface of the particulate additive and the contact surface of the rotatable member. Such phenomena may thus cause the friction-braking force to increase during the latter stages of the friction-braking operation. In some embodiments, one or more particulate additives may be used that provide increased frictional interaction of the friction-braking surface of the friction material, with the contact surface of the rotatable member, due e.g. to softening of the particulate additive during the braking operation. Such softening may be due e.g. to slight local heating effects from the frictional interaction (which heating effects may be sufficiently localized and transient as to be difficult to measure conventionally), and may, for example, allow the surface of the particulate additive to more thoroughly wet out against the contact surface of the rotatable member, thus increasing the frictional interaction.

Exemplary particulate additives that may have beneficial effects due to one or more of the above-discussed mechanisms may include e.g. organic polymeric elastomeric particles such as e.g. rubber particles (whether in the form of granules, powders, etc., and whether made of e.g. natural rubber or of any of the numerous synthetic rubbers and elastomers that are available). In various embodiments, such elastomeric particles may be thermoplastic or may be cross-linked to any desired degree, and may have other compositional and/or processing parameters that are chosen to desirably control properties such as modulus, elasticity or viscoelasticity, tack, softening point, melting point, glass transition temperature (if one exists), and so on.

Other approaches may also be used, e.g. instead of, or in combination with, any of the above approaches. For example, a layer of friction material may comprise an additive that is a non-Newtonian, shear-thickening fluid. Such a fluid might be added directly to a binder that is used to make the friction material; or, it may be e.g. sorbed into particles of a porous material (e.g. a foam) that are dispersed into the binder so that at least some particles and fluid therein are present at the friction-braking surface of the resulting layer of friction material. In still other approaches, a first (matrix) phase of the layer of friction material may be partially or completely formulated of a binder that itself provides shear-thickening behavior. For example, such a binder may comprise shear-rate dependent physical cross-links (e.g. as in the case of certain boric acid-containing poly(siloxane) and poly (vinyl alcohol) materials). Any of the above-discussed approaches may be used, in combination if desired, in order to enhance the braking performance of a fall-protection apparatus.

As noted above, the above-discussed effects involve phenomena (e.g., shear-variance and/or time-variance of dynamic frictional interaction) that may not necessarily be captured or revealed in conventional coefficients of friction as obtained by the testing methods discussed above. The fact that such effects may be usefully employed in a friction brake of a fall-protection apparatus, may have been heretofore overlooked and/or not expected, e.g. in view of the extremely short time scale of such friction-braking operations.

Any of the above-recited materials and ingredients may be used in any combination as desired. As noted, in some embodiments the resulting friction material may be a composite, e.g. multiphasic, material. In some embodiments, the resulting friction material may exhibit at least 0.1, 0.2, 0.5, 1.0, 2.0, 5.0, or 10.0 percent porosity. In other embodiments, the resulting friction material may exhibit less than 8, 4, 1.5, 0.45, 0.25, 0.15, or 0.05 percent porosity. In some embodiments the friction material may comprise a ceramic material (e.g. it may include silicon carbide as a particulate additive or as a sintered binder). In other embodiments, the friction material may contain less than 20, 10, 5, 2, 1, 0.5, or 0.1% by weight of ceramic material. In some particular embodiments, the friction material may contain less than 20, 10, 5, 2, 1, 0.5, or 0.1% by weight of metal (in elemental or alloy form). In specific embodiments, the friction material is not a ceramic material or a sintered material.

As noted, in some embodiments the friction material may be disposed as a layer of friction material that has one major surface that is exposed to provide a friction-braking surface, and another, opposing major surface that is bonded to a support plate. Such a support plate can enhance the mechanical integrity and strength of the layer of friction material, and/or can allow the layer of friction material to be e.g. positioned and held at a particular location within the housing of a fall-protection apparatus (e.g. to be keyed to a shaft or to a drum of the apparatus). In other embodiments the layer of friction material may be free-standing as noted. In some embodiments, the exposed, friction-braking surface of the layer of friction material may be e.g. ground, polished, or the like, e.g. to manipulate the smoothness of the surface.

Since the friction brake is a limited-use item that may be subject to little or no wearing away of the friction material during ordinary use of the fall-protection apparatus, in some embodiments the layer of friction material may be quite thin e.g. in comparison to vehicular brake pads. In various embodiments the layer of friction material may exhibit a thickness equal to or less than 5.0, 4.0, 3.0, 2.5, 2.0, 1.5, or 1.0 mm. In some embodiments the layer of friction material may comprise a multilayer structure with a base layer (e.g. that comprises only binder, or binder and filler, and which itself may be disposed on a metal support plate), and a relatively thin outermost layer that provides the friction-braking surface of the layer of friction material and that comprises e.g. binder and various additives as needed to promote the effects disclosed herein.

If desired, the absolute value of the coefficient of friction of a friction material may be set to any desired range, as long as the effects disclosed herein are allowed. In various embodiments, the coefficient of static friction of the friction-braking surface of the friction material in combination with the contact surface of the rotatable member, may be at least about 0.1, 0.2, 0.3, 0.4, 0.5, or 0.6; in further embodiments, it may be at most about 0.85, 0.65, 0.55, 0.45, 0.35, or 0.25. In various embodiments, the coefficient of dynamic friction of the friction-braking surface of the friction material, may be at least about 0.15, 0.25, 0.35, 0.45, 0.55 or 0.65; in further embodiments, it may be at most about 0.9, 0.7, 0.6, 0.5, 0.4, or 0.2.

Fall-Protection Products

The arrangements disclosed herein may be advantageously used in any fall-protection apparatus; in particular, in a self-retracting lifeline. In addition to the documents previously cited herein, fall-protection apparatus such as e.g. self-retracting lifelines in which the arrangements disclosed herein may be advantageously utilized, are described in U.S. Pat. Nos. 8,181,744, 8,256,574, 8,430,206, 8,430,207, 8,511,434, and 9,488,235, and in U.S. Published Patent Application 2016/0096048.

In some embodiments the fall-protection apparatus is a self-retracting lifeline which meets the requirements of ANSI Z359.14-2014. In general, the arrangements disclosed herein may be used in any fall-protection apparatus in which there is a need to arrest the fall of a human user while minimizing the peak braking force relative to the average braking force. In some embodiments, the arrangements disclosed herein may be used in fall-protection products that, at least in some modes of operation, can function as descenders (e.g. that can allow self-rescue capability) or rope adjusters. For example, the fall-protection apparatus may comprise both a full-arrest (halt) mode and a descending mode, e.g. as described in U.S. Published Patent Application 2010/0226748.

In various embodiments, a fall-protection apparatus as described herein may be used in concert with, or as part of, any suitable fall-protection system such as e.g. a horizontal lifeline or retractable horizontal lifeline, a positioning lanyard, a shock-absorbing lanyard, a rope adjuster or rope grab, a vertical safety system (such as e.g. a flexible cable, rigid rail, climb assist, or fixed ladder safety system), a confined-space rescue system or hoist system, and so on. In some embodiments a fall-protection apparatus as disclosed herein may comprise a housing configured so that the interior of the apparatus is at least partially sealed (such as in the product line available from 3M Fall Protection under the trade designation (SEALED-BLOK) e.g. for use in harsh or marine environments. In some cases a fall-protection apparatus as disclosed herein may be suited for use in so-called "leading edge" workplace environments. It is still further noted that the discussions herein have primarily concerned apparatus (e.g. self-retracting lifelines) that comprise a housing that is e.g. mounted to an overhead anchorage and that comprises a safety line with a distal end that can be attached to a harness of a human user. It will be understood that the arrangements disclosed herein may also be used in e.g. "personal" self-retracting lifelines that comprise a housing that is mountable to a harness of a human user and that comprises a safety line with a distal end that can be attached e.g. to an overhead anchorage. Such apparatus are exemplified by the product line available from 3M Fall Protection under the trade designation TALON.

It will be understood that any such fall-protection apparatus may include, or be used with, various ancillary items which are not described in detail herein. Such items may include, but are not limited to, one or more of lanyards, shock absorbers, tear strips, harnesses, belts, straps, paddings, tool holsters or pouches, impact indicators, carabiners, D-rings, anchorage connectors, and the like. Many such apparatus, products, and components are described in detail e.g. in the 3M DBI-SALA Full-Line Catalog (Fall 2016). Although in many embodiments it may not be necessary due to the presence of the friction brake, in some embodiments the safety line of the apparatus may comprise a shock absorber e.g. of the type described earlier herein. In other embodiments, no such shock absorber will be present. It will be understood that a fall-protection apparatus that is "non-motorized" as defined and described earlier herein, may still include such items as one or more electrically-powered sensors, monitors, communication units, actuators, and the like.

LIST OF EXEMPLARY EMBODIMENTS

Embodiment 1 is a non-motorized fall-protection apparatus comprising: a drum with a safety line connected thereto and that is rotatable relative to a housing of the apparatus; and, a rotationally-activated braking device that comprises at least one pawl and at least one ratchet with at least one tooth that is engagable by an engaging end of the at least one pawl, wherein the rotationally-activated braking device comprises a limited-use, constant-contact friction brake comprising at least one layer of friction material with a friction-braking surface and comprising at least one rotatable member with a contact surface that is in contact with the friction-braking surface of the layer of friction material, and wherein the rotationally-activated braking device and the limited-use, constant-contact friction brake thereof are configured to arrest the rotation of the rotatable drum in a braking operation in which a ratio of peak braking force to average braking force is less than about 1.2.

Embodiment 2 is the apparatus of embodiment 1 wherein the rotationally-activated braking device and the limited-use, constant-contact friction brake thereof are configured to arrest the rotation of the rotatable drum in a braking operation in which a ratio of peak braking force to average braking force is less than about 1.1.

Embodiment 3 is the apparatus of any of embodiments 1-2 wherein the limited-use friction brake is a single-use friction brake.

Embodiment 4 is the apparatus of any of embodiments 1-3 wherein the safety line comprises at least one shock absorber.

Embodiment 5 is the apparatus of any of embodiments 1-3 wherein the safety line does not comprise a shock absorber.

Embodiment 6 is the apparatus of any of embodiments 1-5 wherein the apparatus is a self-retracting lifeline in which the safety line comprises a proximal end that is connected to the rotatable drum and a distal end that is attachable to a harness of a human user of the apparatus or to an anchorage of a workplace.

Embodiment 7 is the apparatus of any of embodiments 1-6 wherein the at least one pawl is biased so that the engaging end of the at least one pawl is urged toward a disengaged position; and, wherein the rotationally-activated braking device is configured so that upon rotation of the rotatable drum above a predetermined value, the engaging end of the at least one pawl is urged into an engaged position in which it engages a tooth of the ratchet.

Embodiment 8 is the apparatus of any of embodiments 1-7 wherein the apparatus comprises at least two pawls that are each mounted on the rotatable drum, wherein the rotatable member of the friction brake serves as the ratchet of the rotationally-activated braking device, wherein the engaging of an engaging end of one of the pawls with a tooth of the ratchet causes the ratchet to rotate relative to the housing of the apparatus, and wherein the at least one layer of friction material is configured to frictionally arrest the rotation of the ratchet relative to the housing of the apparatus thus arresting the rotating of the rotatable drum relative to the housing of the apparatus.

Embodiment 9 is the apparatus of any of embodiments 1-8 wherein the apparatus comprises first and second layers of friction material that sandwich the ratchet therebetween, the first and second layers of friction material being respectively bonded to first and second support plates that are each keyed to a shaft to prevent the first and second layers of friction material from rotating relative to the housing of the apparatus.

Embodiment 10 is the apparatus of any of embodiments 1-7 wherein the apparatus is configured so that the engaging of an engaging end of the at least one pawl with a tooth of the ratchet halts the rotation of the rotatable member with respect to the housing of the apparatus and wherein the layer of friction material is configured to frictionally arrest the rotation of the rotatable drum relative to the rotatable member thus arresting the rotating of the rotatable drum relative to the housing of the apparatus.

Embodiment 11 is the apparatus of any of embodiments 1-7 and 10 wherein the friction brake comprises a single layer of friction material that is keyed to the rotatable drum so as to not be rotatable relative to the drum, wherein the friction brake comprises a single rotatable member that is rotatable relative to the rotatable drum and to a housing of the apparatus and that comprises at least two pawls mounted thereon, and wherein the rotationally-activated braking device comprises a single ratchet that is not rotatable relative to the housing of the apparatus and that is not the single rotatable member of the friction brake.

Embodiment 12 is the apparatus of any of embodiments 1-11 wherein the at least one ratchet is provided as a radially-outward-facing toothed disk or as a radially-inward-facing toothed ring, the ratchet being made of steel.

Embodiment 13 is the apparatus of any of embodiments 1-7 and 10-11 wherein the at least one ratchet is a single ratchet that is provided as an integral feature of the housing of the apparatus or of a load-bearing bracket of the apparatus.

Embodiment 14 is the apparatus of any of embodiments 1-13 wherein the layer of friction material is a non-wear item.

Embodiment 15 is the apparatus of any of embodiments 1-14 wherein the rotationally-activated braking device and the limited-use, constant-contact friction brake thereof are configured to arrest the rotation of the rotatable drum in a braking operation that exhibits a braking force versus time curve in which a local slope of the curve at a peak force of the curve is less than 10 pounds braking force per millisecond of braking time.

Embodiment 16 is the apparatus of any of embodiments 1-15 wherein the rotationally-activated braking device and the limited-use, constant-contact friction brake thereof are configured to arrest the rotation of the rotatable drum in a braking operation in which a ratio of a local initial peak braking force to average braking force is less than about 1.15.

Embodiment 17 is the apparatus of any of embodiments 1-16 wherein the friction-braking surface of the layer of friction material, and the contact surface of the rotatable member, are configured to collectively exhibit a coefficient of static friction and a coefficient of dynamic friction and wherein the coefficient of static friction is about equal to, or less than, the coefficient of dynamic friction.

Embodiment 18 is the apparatus of embodiment 17 wherein the ratio of the coefficient of static friction to the coefficient of dynamic friction is less than or equal to 0.99.

Embodiment 19 is the apparatus of embodiment 17 wherein the ratio of the coefficient of static friction to the coefficient of dynamic friction is less than or equal to 0.95.

Embodiment 20 is the apparatus of any of embodiments 1-19 wherein the friction material is a composite material comprising a first phase that comprises an organic polymeric binder, and a second phase that comprises at least one particulate additive.

Embodiment 21 is a method of operating a fall-protection apparatus comprising a rotationally-activated braking device comprising a limited-use friction brake, the method comprising: upon rotation of a safety line-bearing drum of the apparatus above a predetermined value, engaging at least one pawl of the rotationally-activated braking device with a tooth of a ratchet of the rotationally-activated braking device thus causing a rotatable member of the friction brake to rotatably move relative to a layer of friction material of the friction brake; and, arresting the rotation of the rotatable member of the friction brake relative to the layer of friction material of the friction brake by way of friction between a friction-braking surface of the layer of friction material and a contact surface of the rotatable member, thus arresting the rotation of the rotatable drum in a braking operation in which a ratio of peak braking force to average braking force is less than about 1.2.

Embodiment 22 is the method of embodiment 21 wherein the ratio of peak braking force to average braking force is less than about 1.1.

Embodiment 23 is the method of embodiment 21 wherein the braking operation exhibits a braking force versus time curve in which a local slope of the curve at a peak force of the curve is less than 10 pounds braking force per millisecond of braking time.

Embodiment 24 is the method of embodiment 21 wherein in the braking operation a ratio of a local initial peak braking force to average braking force is less than about 1.15.

Embodiment 25 is the method of embodiment 21, performed using the apparatus of any of embodiments 1-20.

EXAMPLES

Test Methods

The forces encountered during a braking operation of a fall-protection apparatus (e.g. a self-retracting lifeline) may be evaluated by drop-testing performed in accordance with the apparatus and procedures described in section 4.2.1 (dynamic performance testing) of ANSI Z359.14-2014 (Safety Requirements for Self-Retracting Devices for Personal Fall Arrest & Rescue Systems). A braking force vs. time curve may be generated from the resulting data. (Associated parameters such as displacement as a function of time, velocity as a function of time, total arrest distance, and so on, may also be evaluated.) From such testing, an (absolute) peak force may be identified and reported, and an average force may be calculated and reported. (Under the ANSI Z359 procedure, the average force that is reported is a number-average parameter calculated using all data points for which a force of over 500 pounds is present; all average forces mentioned in the present document are obtained using such a procedure.) The force value corresponding to a local, initial peak force is not reported as part of the standard ANSI Z359 procedure; however, if such a local initial peak is present, it can easily identified on the force vs. time curve and the corresponding force can be easily obtained. The local slope of the force curve at the peak force that occurs during the braking operation is not reported as part of the standard ANSI Z359 procedure, but can be easily obtained from the force vs. time curve. For purposes of such characterization, a time increment (starting from the time of peak force and proceeding forward in time) of 4 milliseconds or until a significant local minimum in force is encountered, can be used.

Comparative Example

A self-retracting lifeline fall-protection apparatus was obtained from 3M Fall Protection, Red Wing, Minn., under the trade designation ULTRA-LOK (product number 3504430). The apparatus included a friction brake of the general type depicted in FIG. 3, comprising first and second friction disks each comprising a layer of friction material bonded to a steel support plate keyed to a shaft of the apparatus.

The fall-protection apparatus as received was subjected to drop testing as described above, using a drop weight of 282 pounds. To perform the test, the weight was attached to the distal end of the safety line of the apparatus and then lowered via a winch down and away from the apparatus until approximately three feet of safety line had been extended. From there a quick release was used to release the weight from the winch cable to initiate the test. Force, displacement, velocity, and associated parameters were recorded. The force (in pounds of force, units on the left Y axis), along with the displacement (i.e. distance of falling, in inches, units on the right Y axis), as a function of time is presented in FIG. 4. The average force ($F_A$) was 658 pounds; the peak force ($F_P$) was 926 pounds. The force value corresponding to a local, initial peak force could be easily identified as corresponding to the overall peak force of 926 pounds.

The local slope of the force curve at the peak force that occurs during the braking operation is not reported as part of the standard ANSI Z359 procedure, but could be easily calculated from the force curve. For the Comparative Example, from FIG. 4 the local slope of the force curve at the peak force was calculated as 926-655 (in pounds of force) divided by 4 milliseconds, or approximately 68 pounds force per millisecond of braking time.

Working Example

A self-retracting lifeline fall-protection apparatus was assembled that was essentially identical to the above-described ULTRA-LOK (product number 3504430), except that first and second friction disks were used (of essentially identical size and shape as those described in the Comparative Example, and comprising a layer of friction material bonded to a steel support plate), that each comprised a layer of friction material obtained from PMA Friction Materials, Batavia Ill., under the product number 161014. The apparatus was assembled with the locking nut of the rotationally-activated braking device being tightened to an appropriate amount via use of a torque wrench.

The fall-protection apparatus was then subjected to drop testing as described above. The force (in pounds of force), along with the displacement as a function of time is presented in FIG. 5. The average force was approximately 651 pounds; the (overall) peak force was approximately 721 pounds. The force value corresponding to a local, initial peak force could be easily identified from the force curve (and is labeled on FIG. 5 as $F_{LIP}$) as being approximately 680 pounds. The local slope of the force curve at the peak force was calculated as 721-720 (in pounds of force) divided by 4 milliseconds, or approximately 0.2 pounds force per millisecond.

Multiple testing of Working Example and Comparative Example fall-protection apparatus was performed; the Examples presented herein were selected as being representative of the behavior observed. The foregoing Examples have been provided for clarity of understanding only, and no unnecessary limitations are to be understood therefrom. The tests and test results described in the Examples are intended to be illustrative rather than predictive, and variations in the testing procedure can be expected to yield different results. All quantitative values in the Examples are understood to be approximate in view of the commonly known tolerances involved in the procedures used.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). Although various theories and possible mechanisms may have been discussed herein, in no event will such discussions serve to limit the claimable subject matter. To the extent that there is any conflict or discrepancy between this specification as written and the disclosure in any document that is incorporated by reference herein but to which no priority is claimed, this specification as written will control.

What is claimed is:

1. A non-motorized fall-protection apparatus comprising:

a drum with a safety line connected thereto and that is rotatable relative to a housing of the apparatus; and, a rotationally-activated braking device that comprises at least one pawl and at least one ratchet with at least one tooth that is engagable by an engaging end of the at least one pawl, wherein the rotationally-activated braking device comprises a limited-use, constant-contact friction brake comprising at least one layer of friction material with a friction-braking surface and comprising at least one rotatable member with a contact surface that is in contact with the friction-braking surface of the layer of friction material, and wherein the rotationally-activated braking device and the limited-use, constant-contact friction brake thereof are configured to arrest the rotation of the rotatable drum in a braking operation in which a ratio of peak braking force to average braking force is less than about 1.2.

2. The apparatus of claim 1 wherein the rotationally-activated braking device and the limited-use, constant-contact friction brake thereof are configured to arrest the rotation of the rotatable drum in a braking operation in which a ratio of peak braking force to average braking force is less than about 1.1.

3. The apparatus of claim 1 wherein the limited-use friction brake is a single-use friction brake.

4. The apparatus of claim 1 wherein the safety line comprises at least one shock absorber.

5. The apparatus of claim 1 wherein the safety line does not comprise a shock absorber.

6. The apparatus of claim 1 wherein the apparatus is a self-retracting lifeline in which the safety line comprises a proximal end that is connected to the rotatable drum and a distal end that is attachable to a harness of a human user of the apparatus or to an anchorage of a workplace.

7. The apparatus of claim 1 wherein the at least one pawl is biased so that the engaging end of the at least one pawl is urged toward a disengaged position; and, wherein the rotationally-activated braking device is configured so that upon rotation of the rotatable drum above a predetermined value, the engaging end of the at least one pawl is urged into an engaged position in which it engages a tooth of the ratchet.

8. The apparatus of claim 1 wherein the apparatus comprises at least two pawls that are each mounted on the rotatable drum, wherein the rotatable member of the friction brake serves as the ratchet of the rotationally-activated braking device, wherein the engaging of an engaging end of one of the pawls with a tooth of the ratchet causes the ratchet to rotate relative to the housing of the apparatus, and wherein the at least one layer of friction material is configured to frictionally arrest the rotation of the ratchet relative to the housing of the apparatus thus arresting the rotating of the rotatable drum relative to the housing of the apparatus.

9. The apparatus of claim 8 wherein the apparatus comprises first and second layers of friction material that sandwich the ratchet therebetween, the first and second layers of friction material being respectively bonded to first and second support plates that are each keyed to a shaft to prevent the first and second layers of friction material from rotating relative to the housing of the apparatus.

10. The apparatus of claim 1 wherein the apparatus is configured so that the engaging of an engaging end of the at least one pawl with a tooth of the ratchet halts the rotation of the rotatable member with respect to the housing of the apparatus and wherein the layer of friction material is configured to frictionally arrest the rotation of the rotatable drum relative to the rotatable member thus arresting the rotating of the rotatable drum relative to the housing of the apparatus.

11. The apparatus of claim 1 wherein the friction brake comprises a single layer of friction material that is keyed to the rotatable drum so as to not be rotatable relative to the drum, wherein the friction brake comprises a single rotatable member that is rotatable relative to the rotatable drum and to a housing of the apparatus and that comprises at least two pawls mounted thereon, and wherein the rotationally-activated braking device comprises a single ratchet that is not rotatable relative to the housing of the apparatus and that is not the single rotatable member of the friction brake.

12. The apparatus of claim 1 wherein the at least one ratchet is provided as a radially-outward-facing toothed disk or as a radially-inward-facing toothed ring, the ratchet being made of steel.

13. The apparatus of claim 1 wherein the at least one ratchet is a single ratchet that is provided as an integral feature of the housing of the apparatus or of a load-bearing bracket of the apparatus.

14. The apparatus of claim 1 wherein the layer of friction material is a non-wear item.

15. The apparatus of claim 1 wherein the rotationally-activated braking device and the limited-use, constant-contact friction brake thereof are configured to arrest the rotation of the rotatable drum in a braking operation that exhibits a braking force versus time curve in which a local slope of the curve at a peak force of the curve is less than 10 pounds braking force per millisecond of braking time.

16. The apparatus of claim 1 wherein the rotationally-activated braking device and the limited-use, constant-contact friction brake thereof are configured to arrest the rotation of the rotatable drum in a braking operation in which a ratio of a local initial peak braking force to average braking force is less than about 1.15.

17. A method of operating a fall-protection apparatus comprising a rotationally-activated braking device comprising a limited-use friction brake, the method comprising:

upon rotation of a safety line-bearing drum of the apparatus above a predetermined value, engaging at least one pawl of the rotationally-activated braking device with a tooth of a ratchet of the rotationally-activated braking device thus causing a rotatable member of the friction brake to rotatably move relative to a layer of friction material of the friction brake;

and, arresting the rotation of the rotatable member of the friction brake relative to the layer of friction material of the friction brake by way of friction between a friction-braking surface of the layer of friction material and a contact surface of the rotatable member, thus arresting the rotation of the rotatable drum in a braking operation in which a ratio of peak braking force to average braking force is less than about 1.2.

18. The method of claim 17 wherein the ratio of peak braking force to average braking force is less than about 1.1.

19. The method of claim 17 wherein the braking operation exhibits a braking force versus time curve in which a local slope of the curve at a peak force of the curve is less than 10 pounds braking force per millisecond of braking time.

20. The method of claim 17 wherein in the braking operation a ratio of a local initial peak braking force to average braking force is less than about 1.15.

* * * * *